United States Patent [19]

Jordan

[11] 4,027,966

[45] June 7, 1977

[54] TRACKING ASSEMBLY FOR AN ENDLESS BELT ELECTROSTATIC REPRODUCTION MACHINE

[75] Inventor: William E. Jordan, Penfield, N.Y.

[73] Assignee: Xerox Corporation, Stamford, Conn.

[22] Filed: Mar. 25, 1976

[21] Appl. No.: 670,304

Related U.S. Application Data

[63] Continuation of Ser. No. 418,720, Nov. 23, 1973, abandoned.

[52] U.S. Cl. ..... 355/16; 198/806; 355/3 R

[51] Int. Cl.[2] ..... G03G 15/00

[58] Field of Search ..... 355/16, 3 R, 3 BE; 198/806; 226/21–23

[56] References Cited

UNITED STATES PATENTS

| | | | |
|---|---|---|---|
| 3,090,534 | 5/1963 | Frommer et al. | 198/202 |
| 3,161,283 | 12/1964 | Knab et al. | 198/202 |
| 3,368,665 | 2/1968 | Jinkins | 198/202 |
| 3,435,693 | 4/1969 | Wright et al. | 198/202 |
| 3,540,571 | 11/1970 | Morse | 198/202 |
| 3,545,599 | 12/1970 | Smith et al. | 198/202 |
| 3,702,131 | 11/1972 | Stokes et al. | 198/202 |
| 3,726,588 | 4/1973 | Moser | 198/202 |
| 3,818,391 | 6/1974 | Jordon et al. | 355/3 R |

*Primary Examiner*—R. L. Moses
*Attorney, Agent, or Firm*—Earl T. Reichert

[57] ABSTRACT

An electrostatic reproduction machine has a belt assembly having a plurality of rollers for supporting and moving an endless photoconductive belt around a closed path. A tracking apparatus is used to detect and correct lateral movement of the belt as it moves around the rollers, and to return the belt to its normal course, the apparatus including (1) a sensing member for sensing the lateral movement of the belt as the latter moves around a first of the rollers, (2) structure for connecting the sensing member to a second of the rollers, the second roller being mounted to rotate about an axis in response to lateral movement of the belt to cause the belt to return to its normal course, and (3) a resilient member connected to both the connecting structure and stationary frame structure. The resilient member supports the entire weight of the sensing member and connecting structure, and causes the sensing member to return to its initial position after being displaced by lateral movement of the belt.

3 Claims, 2 Drawing Figures

TRACKING ASSEMBLY FOR AN ENDLESS BELT ELECTROSTATIC REPRODUCTION MACHINE

This is a continuation of application Ser. No. 418,720, now abandoned, filed Nov. 23, 1973.

BACKGROUND OF THE INVENTION

This invention relates to an electrostatic reproduction machine, but more particularly to improvements in a belt tracking system for an endless photoconductor belt of the machine.

In the practice of xerography as described in U.S. Pat. No. 2,297,691 to Chester F. Carlson, a xerographic surface comprising a layer of photoconductive insulating material affixed to a conductive backing is used to support electrostatic images. In the usual method of carrying out the process, the xerographic plate is electrostatically charged uniformly over its surface and then exposed to a light pattern of the image being reproduced to thereby discharge the charge in the areas where light strikes the layer. The undischarged areas of the layer thus form an electrostatic charge pattern in conformity with the configuration of the original light pattern.

The latent electrostatic image may then be developed by contacting it with a finely divided electrostatically attractable material, such as a resinous powder. The powder is held in the image areas by the electrostatic fields on the layer. Where the field is greatest, the greatest amount of material is deposited; and where the field is least, little or no material is deposited. Thus, a powder image is produced in conformity with the light image of the copy being reproduced. The powder is subsequently transferred to a sheet of paper or other surface and suitably fixed to thereby form a permanent print.

The latest machine concept for copiers utilizes high speed flash exposure of a document, and the arrangement of a moving photoconductor material in the form of an endless belt. Photoconductor belts are very delicate, are easily damaged, and the movement thereof through processing stations in the reproduction machine must be accomplished with high precision and with as little irregular movement as possible. Present tracking systems for tracking such belts require very precise machining, and the use of very accurate linkages and ball bearings which both increases the costs and the number of maintenance problems. Thus, what is needed is a reliable low cost tracking system.

SUMMARY OF THE INVENTION

The present invention is directed to an electrostatic reproduction machine having a belt assembly for supporting and moving an endless photoconductive belt. The belt assembly has a plurality of rollers, one of which is a tracking roller. A sensing ring mounted at the end of one roller senses any lateral deviations of the belt from its normal course, and in response thereto causes the tracking roller to rotate about an axis to move the belt back to its normal course. The sensing ring causes movement of the tracking roller via an intermediate flexible torsion bar.

BRIEF DESCRIPTION OF THE DRAWINGS

A better understanding of the present invention as well as other objects and further features thereof will become apparent upon consideration of the following detailed disclosure thereof, especially when taken with the accompanying drawings, wherein like numerals designate like parts throughout.

DETAILED DESCRIPTION OF THE INVENTION

Figure 1:
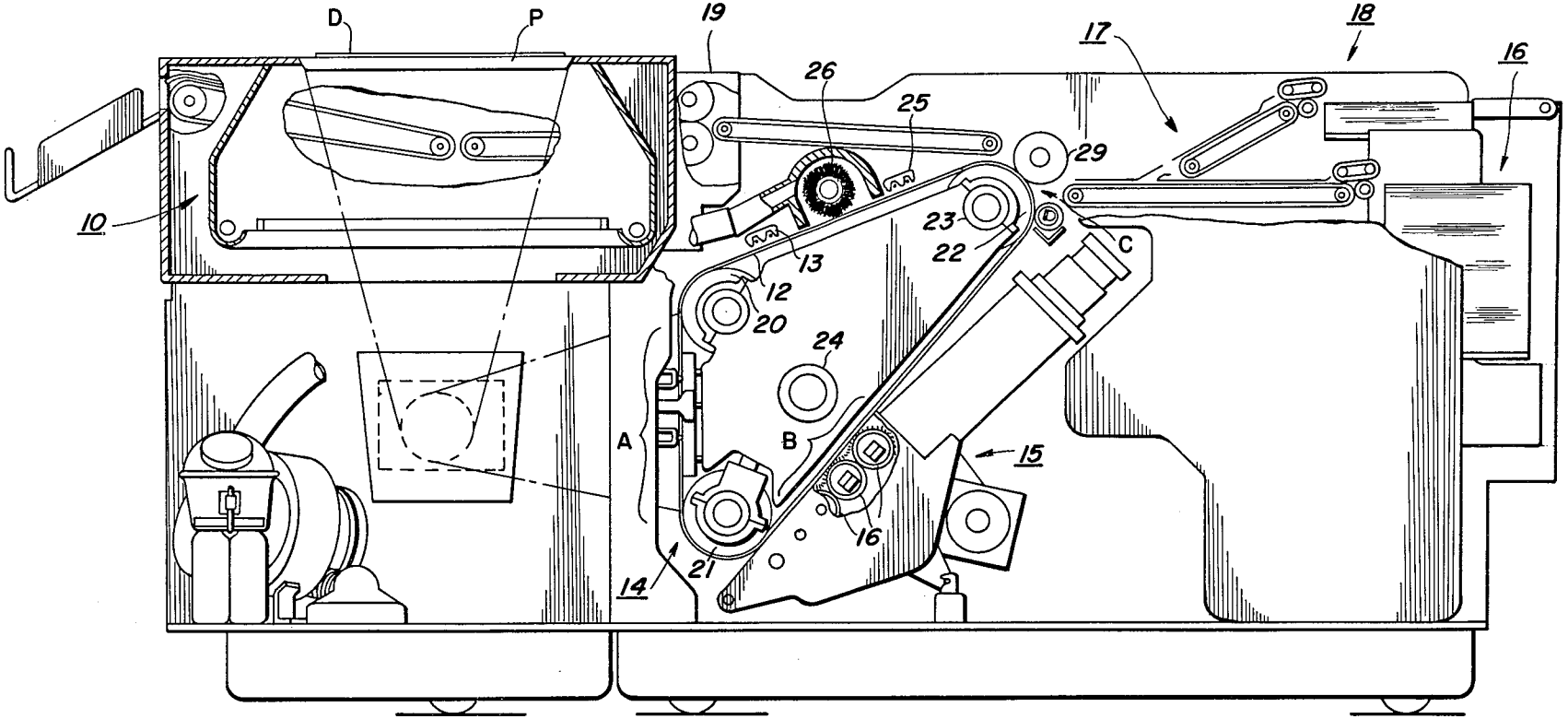
FIG. 1 is a schematic sectional view of an electrostatic reproduction machine embodying the principles of the invention.

For a general understanding of the illustrated copier reproduction machine in which the invention may be incorporated, reference is had to FIG. 1 in which the various system components for the machine are schematically illustrated. A document to be copied is placed upon a transparent support platen P fixedly arranged in an illumination assembly, generally indicated by the reference numeral 10, positioned at the left end of the machine. Light rays from an illumination system are flashed upon the document to produce image rays corresponding to the informational areas. The image rays are projected by means of an optical system onto the photosensitive surface of a xerographic plate in the form of a flexible photoconductive belt 12 arranged on a belt assembly, generally indicated by the reference numeral 14.

The belt is comprised of a photoconductive layer of selenium which is the light receiving surface and imaging medium for the apparatus formed on a conductive backing. The surface of the photoconductive belt is made photosensitive by a previous step of uniformly charging the same by means of a corona generating device or corotron 13.

The belt is journaled for continuous movement upon three rollers 20, 21 and 22 positioned with their axes in parallel. The photoconductive belt assembly 14 is slidably mounted upon two support shafts 23 and 24 with the roller 22 rotatably supported on the shaft 23 which is secured to the frame of the apparatus and is rotatably driven by a suitable motor and drive assembly (not shown) in the direction of the arrow at a constant rate. During exposure of the belt 12, the portion exposed is that portion of the belt running between rollers 20 and 21. During movement of the belt 12, the reflected light image of the original document positioned on the platen on the surface of the belt to produce an electrostatic latent image thereon at exposure station A.

As the belt surface continues its movement, the electrostatic image is passed through a developing station B in which there is positioned a developer assembly, generally indicated by the reference numeral 15, and which effects development of the electrostatic image by means of multiple magnetic brushes 16 as the image moves through the development zone.

The developed electrostatic image is transported by the belt to a transfer station C where a sheet of copy paper is moved between a transfer roller 29 and the belt at a speed in synchronism with the moving belt in order to accomplish transfer of the developed image by an electrical bias on the transfer roller. There is provided at this station a sheet transport mechanism, generally indicated at 17, adapted to transport sheets of paper from a paper handling mechanism, generally indicated by the reference numeral 18, to the developed image on the belt at the station C.

After the sheet is stripped from the belt 12, it is conveyed into a fuser assembly, generally indicated by 19, wherein the developed and transferred xerographic powder image on the sheet material is permanently fixed thereto. After fusing, the finished copy is discharged from the apparatus at a suitable point for collection externally of the apparatus. The toner particles remaining as residue on the developed image, background particles and those particles otherwise not transferred are carried by the belt 12 to a cleaning apparatus 26 positioned on a course of the belt between rollers 20 and 22 adjacent to charge device 25.

Further details regarding the structure of the belt assembly 14 and its relationship with the machine and support therefor may be found in the copending application Ser. No. 102,312, assigned to the same assignee.

Figure 2:
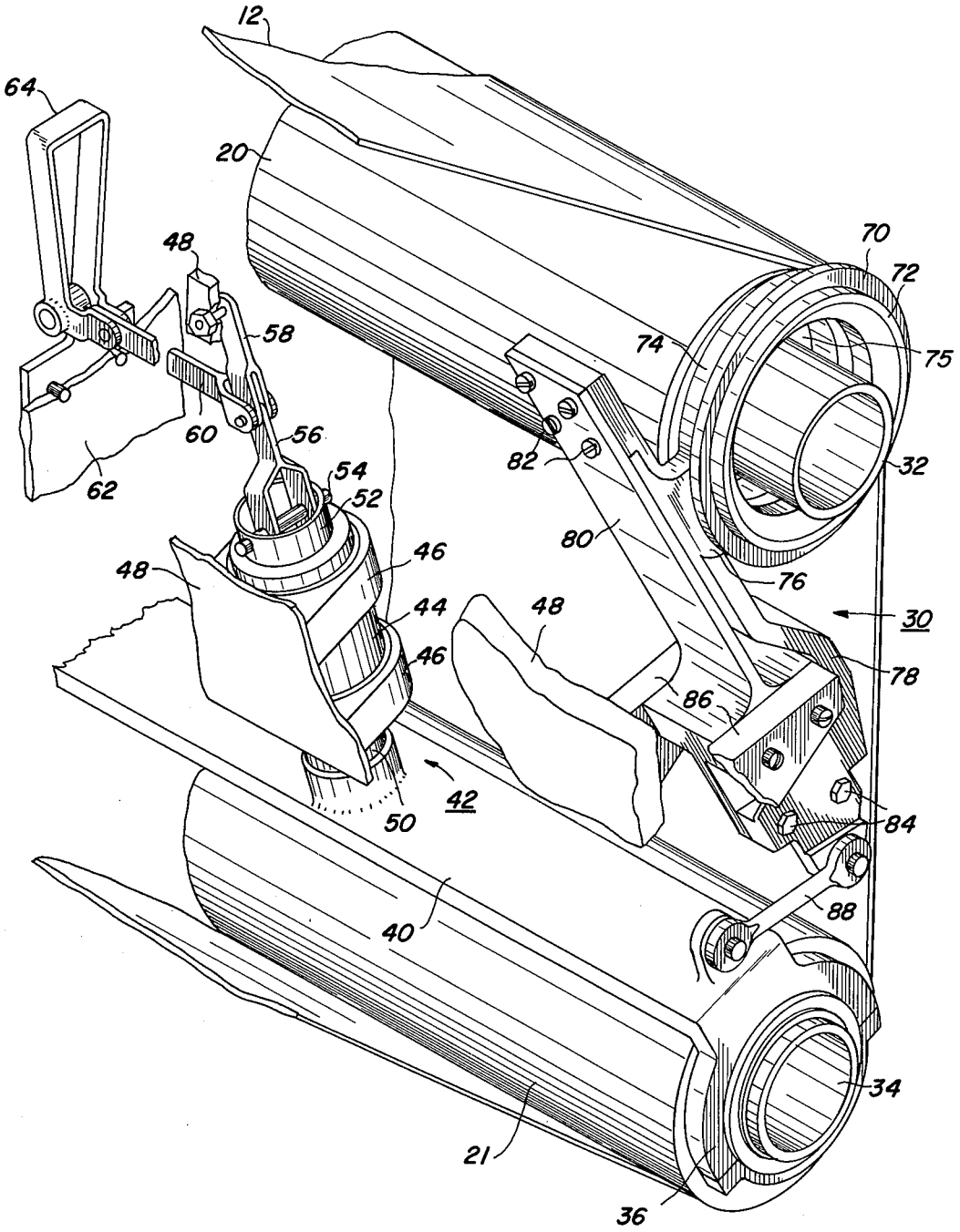
FIG. 2 is an isometric view of a portion of the belt and tracking assemblies.

Referring now to FIG. 2, there is illustrated a tracking assembly, generally indicated as 30 including the upper roller 20 and the tracking roller 21. The upper roller 20 is rotatably supported on a hollow shaft 32 journaled for rotation in bearings disposed in side plates (not shown) such as described in corresponding application Ser. No. 102,311 now U.S. Pat. No. 3,702,131 to David R. Stokes, et al. entitled "Belt Tracking System", assigned to the same assignee. The tracking roller 21 is secured to a shaft 34 journaled for rotation in bearings (not shown) secured to the ends of parallel legs 36 on the ends of yoke member 40.

At the midpoint of the yoke member 40 and extending in an opposite direction relative to the legs 36 and 38, there is provided a shaft, generally indicated as 42, to support the yoke member 40 for limited rotational movement about the axis of the shaft 42 and to permit slight retraction. The shaft 42 is positioned within a cylinder 44 of relatively large diameter disposed within spaced bearings 46 mounted to a frame 48 and having a coaxial reduced portion 50 secured to the lower portion of the cylinder 44 and disposed within a suitable opening, formed in the blight portion of the yoke member 40. A relatively heavy coil spring encircles the portion 50 between the yoke member 40 and the lower surface of the lower bearing 46; this spring imparts a continuous downward force upon the yoke and consequently the roller 21 when the belt 12 is mounted on its supporting rollers, thereby placing belt 12 under slight tension during operation. The structural connection between the yoke member and the portion 50 is slightly loose to allow for limited play between these parts to correct for circumferential variations in manufactured belts.

The upper portion of the cylinder 44 is formed with a tubular sleeve 52 axially aligned therewith. Suitable openings are formed in the sleeve 52 in diametrically opposed positions for supporting a pin 54 which is pivotally connected to one end of a toggle link 56 to the end of the cylinder. The link 56 is pivotally connected at the other end to one end of another toggle link 58 having its opposite end pivotally connected to the frame structure 48. It will be apparent that the toggle links 56 and 58 and their respective connections form a toggle assembly which when moved into alignment will cause the cylinder 44 to move downwardly within the bearing 46 and when moved into a buckled condition will cause the cylinder 44 to be retracted upwardly.

Actuation of the toggle assembly is produced by a drive link 60 which is pivotally connected at one end to the pivot connection between toggle links 56 and 58 extending transverse of the belt assembly through an outer wall 62 and terminating in a pivotal handle 64 which moves drive link 60 axially to actuate toggle links 56 and 58. In order to remove or to replace photoconductive belt 12, the handle 64 is moved so as to cause buckling of the toggle links 56 and 58 which action draws the cylinder 42 upwardly within the bearings 46 to retract the roller 21. Sufficient slack is thereby provided to the belt 12 to permit an operator to move a belt relatively easily over the rollers 20, 21 and 22. After placing a belt over the rollers the handle 64 is moved in an opposite direction to place the toggle links 56 and 58 in an aligned condition thereby forcing the roller 21 against the belt 12 and locking the roller 21 in such position.

A flat sensing ring 70 is mounted for rotation about a bearing 72 disposed on a support plate 74 having a diameter smaller than roller 20 and provided with a curved arm 76. The sensing ring 70 is preferably made of wear-resistant plastic material which will not become damaged when placed in contact with the relatively sharp edge of the photoconductive belt 12, and which will not cause fraying or other damage to the co-acting edge of the belt 12. The support plate 74 is provided with a central opening 78 which allows the assembled structure comprising ring 70, bearing 72 and the plate 74 to accommodate and avoid the adjacent end of the shaft 32 and allow the ring 70 to engage the edge of the belt 12.

The support plate 74 includes a curved arm 76 which merges into a section 78, the latter section being secured to a flexible torsion bar 80. A suitable material for the torsion bar 80 is plastic, but other materials may also be used. The load that it is desired be incorporated against the belt 12 determines the material selected for the torsion bar, and the cross-section of that torsion bar. As can be seen, the section 78 of the support plate 74 is connected to the torsion bar at its upper end by means of bolts 82, and at its lower end by means of bolts 84. The central portion of torsion bar 80 is connected to arm members 86 which in turn are connected to a portion of the frame 48 of the machine The lower end of section 78 is also connected to the yoke 40 via a link 88.

Thus, as can be seen, movement of the sensing ring 70 in either direction will cause the support plate 74 and section 78 thereof to move due to the twisting of torsion bar 80. This causes the yoke member 40 to rotate about the axis of portion 50 for producing the same motion of tracking roller 21. Movement of the sensing ring 70 in either direction will thus result in the rotation of tracking roller 21 in either direction and thereby cause tracking of the belt 12 in a direction opposite that in which the sensing ring movement occurs when the edge of the belt 12 deviates from a predetermined portion relative to the guide roller 20.

For accurate alignment and positioning of electrostatic latent images and then corresponding developed images with respect to the processing stations of the printing machine, it is necessary that the photoreceptor belt maintain a constant and predictable path of movement.

While the invention has been described with reference to the structure disclosed, it is not confined to the details set forth; but is intended to cover such modifications or changes as may come within the scope of the following claims.

What is claimed is:

1. An improved electrostatic reproduction machine having an endless belt assembly and a stationarily mounted frame member, the belt assembly having a plurality of rollers adapted to support an endless belt having a photoconductive area thereon, the improvement comprising tracking means for sensing a lateral deviation of the belt from its normal course as it moves over a first of the rollers, and for rotating a second of the rollers about an axis in response to any deviation so as to return the belt to its normal course, the tracking means including a sensing member mounted so as to be contacted and moved by an edge of the belt during a lateral deviation of the latter, means connecting the sensing member to the second roller, and resilient means connected to both the frame member and the connecting means for supporting the entire weight of both the sensing member and the connecting means and for causing the sensing member to return to its initial position after being moved by a lateral deviation of the belt.

2. An improved electrostatic reproduction machine as set forth in claim 1, wherein the resilient means comprises a flexible torsion bar mounted so as to twist when the sensing member is moved by a lateral deviation of the belt.

3. An improved electrostatic reproduction machine as set forth in claim 2, wherein the torsion bar is connected to the frame member at a location which is intermediate the ends of the torsion bar, and wherein each end of the torsion bar is connected to the connecting means.

* * * * *